US007699318B1

(12) United States Patent
Ko

(10) Patent No.: US 7,699,318 B1
(45) Date of Patent: Apr. 20, 2010

(54) WAGERING METHOD INCLUDING A REVERSE BET

(75) Inventor: Bernard Chung Bon Ko, Foster City, CA (US)

(73) Assignee: TAJA Enterprises, LLC, Livermore, CA (US)

( * ) Notice: Subject to any disclaimer, the term of this patent is extended or adjusted under 35 U.S.C. 154(b) by 732 days.

(21) Appl. No.: 11/254,563

(22) Filed: Oct. 19, 2005

Related U.S. Application Data

(63) Continuation-in-part of application No. 10/947,188, filed on Sep. 21, 2004, now abandoned.

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,226,661 | A | 7/1993 | Wolf | |
| 5,248,142 | A | 9/1993 | Breeding | |
| 5,275,416 | A | 1/1994 | Schorr et al. | |
| 5,314,194 | A | 5/1994 | Wolf | |
| 5,397,128 | A * | 3/1995 | Hesse et al. | 273/292 |
| 5,503,401 | A | 4/1996 | Nguyen | |
| 5,529,309 | A * | 6/1996 | Bartlett | 273/292 |
| 5,540,444 | A | 7/1996 | Nguyen | |
| 5,560,613 | A | 10/1996 | Nguyen | |
| 5,584,486 | A | 12/1996 | Franklin | |
| 5,607,161 | A | 3/1997 | Skratulia | |
| 5,645,281 | A | 7/1997 | Hesse et al. | |
| 5,685,774 | A | 11/1997 | Webb | |
| 5,725,216 | A | 3/1998 | Jones | |
| 5,803,460 | A | 9/1998 | Hesse | |
| 5,863,041 | A | 1/1999 | Boylan et al. | |
| 6,007,424 | A | 12/1999 | Evers et al. | |
| 6,012,720 | A | 1/2000 | Webb | |
| 6,050,569 | A | 4/2000 | Taylor | |
| 6,070,876 | A * | 6/2000 | Ko | 273/293 |
| 6,105,964 | A | 8/2000 | Maahs | |
| 6,135,453 | A | 10/2000 | Srichayaporn | |
| 6,135,454 | A | 10/2000 | Mostashari | |
| 6,270,078 | B1 | 8/2001 | Leone et al. | |
| 6,332,614 | B1 | 12/2001 | Hesse | |
| 6,394,456 | B1 | 5/2002 | Long | |
| 6,402,147 | B1 | 6/2002 | Lo | |

(Continued)

OTHER PUBLICATIONS

Co-pending U.S. Appl. No. 11/697,029, filed Apr. 5, 2007 entitled Method for Adding Qualifier to Casino Games.

(Continued)

*Primary Examiner*—Benjamin H Layno
(74) *Attorney, Agent, or Firm*—Lewis and Roca LLP

(57) ABSTRACT

A method of wagering for games where there can be more than one player hand dealt and each player hand is compared to a Dealer hand. The method of wagering adds an option to wager that the Dealer hand will beat a particular player hand, a wager that the Dealer hand will push with or tie a particular player hand, or both additional wagers. The method of wagering may be supported by a special layout for wagers on the Dealer hand, and this layout may be able to move around the table or it may be stationary.

13 Claims, 3 Drawing Sheets

U.S. PATENT DOCUMENTS

| | | | | |
|---|---|---|---|---|
| 6,409,174 | B1 | 6/2002 | Demarest | |
| 6,474,646 | B1 | 11/2002 | Webb | |
| 6,481,717 | B1 | 11/2002 | Richardelle | |
| 6,491,302 | B1 | 12/2002 | Boylan et al. | |
| 6,503,145 | B1 | 1/2003 | Webb | |
| 6,511,071 | B1 | 1/2003 | Artle et al. | |
| 6,575,464 | B1 | 6/2003 | Fertitta et al. | |
| 6,719,291 | B1 * | 4/2004 | deKeller | 273/274 |
| 6,811,153 | B1 | 11/2004 | Ko | |
| 7,044,468 | B2 | 5/2006 | Sklansky et al. | |
| 7,070,505 | B2 | 7/2006 | Vancura et al. | |
| 7,147,227 | B2 | 12/2006 | Taghavi | |
| 7,195,244 | B1 * | 3/2007 | Feola | 273/292 |
| 7,487,970 | B1 | 2/2009 | Ko | |
| 2005/0029742 | A1 | 2/2005 | Snow | |
| 2005/0170875 | A1 | 8/2005 | Snow | |
| 2006/0055112 | A1 | 3/2006 | Lean et al. | |
| 2006/0084505 | A1 | 4/2006 | Yoseloff et al. | |
| 2007/0235939 | A1 | 10/2007 | Ko | |

OTHER PUBLICATIONS

Co-pending U.S. Appl. No. 11/733,878, filed Apr. 11, 2007 entitled Wagering Method Including a Push Bet.

Co-pending U.S. Appl. No. 12/247,172, filed Oct. 7, 2008 entitled "Wagering Method Including a Reverse Bet".

Office Action dated Sep. 22, 2006 in parent U.S. Appl. No. 10/947,188, filed Sep. 21, 2004 entitled "Pai-Gow Poker Game".

Final Office Action dated Mar. 12, 2007 in parent U.S. Appl. No. 10/947,188, filed Sep. 21, 2004 entitled "Pai-Gow Poker Game".

Notice of Allowance dated Oct. 2, 2008 in parent U.S. Appl. No. 10/947,188, filed Sep. 21, 2004 entitled "Pai-Gow Poker Game".

Notice of Allowance dated Dec. 2, 2008 in parent U.S. Appl. No. 10/947,188, filed Sep. 21, 2004 entitled "Pai-Gow Poker Game".

Office Action dated Jun. 17, 2009 in copending U.S. Appl. No. 11/697,029, filed Apr. 5, 2007 entitled "Method for Ading Qualifer to Casino Games".

Office Action dated Oct. 7, 2008 in copending U.S. Appl. No. 11/733,878, filed Apr. 11, 2007 entitled "Wagering Method Including a Push Bet".

Interview Summary dated Jan. 29, 2009 in copending U.S. Appl. No. 11/733,878, filed Apr. 11, 2007 entitled "Wagering Method Including a Push Bet".

Interview Summary dated Jul. 13, 2009 in co-pending U.S. Appl. No. 11/697,029, filed Apr. 5, 2007 entitled "Method for Adding Qualifier to Casino Games."

Co-pending U.S. Appl. No. 11/697,029, filed Apr. 5, 2007 entitled Method for Adding Qualifier to Casino Games.

Co-pending U.S. Appl. No. 11/697,029 filed Apr. 5, 2007 entitled Method for Adding Qualifier to Casino Games.

* cited by examiner

WAGERING METHOD INCLUDING A REVERSE BET

CROSS-REFERENCE TO RELATED APPLICATIONS

This application is a continuation-in-part of patent application Ser. No. 10/947,188, filed Sep. 21, 2004 now abandoned, which is hereby incorporated by reference as if set forth herein.

BACKGROUND

1. Field of the Invention

The present invention relates to wagering games. More particularly, the present invention relates to a group of games where there is one hand or value commonly called the "Dealer hand", at least one and possibly more than one hand or value commonly called the "player hand", and wagers are decided by comparing each player hand to the Dealer hand.

2. The Prior Art

Numerous wagering games are known in the prior art. Many of them involve the parties each being given a hand, which consists of a group of cards, tiles, or other gaming pieces. This invention involves games where one of these hands is designated the "Dealer" hand. In some cases, this hand is called the "Player/Dealer hand" or the "Bank Hand". In addition, a number of players can each have their own player hand. Players wager on their own player hand and the outcome of the wager is decided by comparing the player hand to the Dealer hand according to a criterion specified by the rules of the game.

The description of the invention discusses the Dealer and the players having "hands". While a "hand" is normally considered to consist of a collection of playing cards, the word "hand" is used for convenience, and is not intended to restrict the invention to games played with collections of playing cards. For the purposes of this invention, a "hand" can also be a collection of tiles or dominos, the outcome of throwing one or more dice, or any other way of assigning a value to a Dealer and players to decide wagers between them.

There are two major types of games involving a Dealer hand. In one group there is always one Dealer hand and one player hand. The best-known example of this is traditional baccarat. Games where only one player hand is allowed do not fall within the field of this invention.

The other type of game involving a Dealer hand allows more than one player hand. These games comprise the field of this invention. Some of the most common games involving a Dealer hand and multiple player hands are Blackjack, Pai Gow, Pai Gow Poker, EasyPoker, Pan 9, and Fast 9.

In jurisdictions where banking games are allowed, typically the casino or the establishment operating the game ("the house") funds the Dealer hand. A banking game is a game where the casino plays an active role in the games and makes a profit by collecting losing wagers from the players. The casino pays all winning wagers. The casino collects all losing wagers. And a casino employee makes all playing decisions involving the Dealer hand, typically according to a set of playing rules.

In jurisdictions where banking games are not allowed, players take turns acting as Dealer. In some other jurisdictions, one or more players may be agent(s) of the house, but other players may also take their turn to be Dealer. In all these cases, each time the game is played, a player is designated as "Player/Dealer", and puts up a wager, and receives a hand. All other players make a wager and receive a hand. They are trying to beat the hand of the Player/Dealer. If the player wins, the player is paid from the Player/Dealer's wager, if there is sufficient money to pay the Player. If the player loses, the player loses his/her wager to the Player/Dealer, if the Player/Dealer's wager was sufficient to cover the player's wager. Usually there are some circumstances that are defined as a "push", and when this occurs, no money changes hands.

When a wager on the Dealer hand is allowed, the wager is against all the player hands, if the wager is large enough to cover all the wagers on the player hands. If the wager on the Dealer hand is not large enough to cover all the player hands, it is a wager against one or more of the player hands, but it is not specifically against one player hand. A random event, such as the value of a card or the throw of one or more dice is used to decide the order of settling wagers. So if a player makes a wager on the Dealer hand that is not large enough to cover all of the bets on player hands, he does not know which player hand(s) he is wagering against, when he makes the wager.

There are many variations of how the Player/Dealer's wager is funded. Two or more parties may share equally in funding the wager. Two or more parties may make separate wagers, where the second or third wager only comes into play when wagers equal to the size of the first Player/Dealer wager have been settled. Also players wagering against the Player/Dealer may combine their funds to wager on a hand or make separate wagers on a hand.

In addition, there are different ways to fund wagers on the player hand. Usually, the player that makes the decision on a hand wagers on their own hand. However, in many casinos more than one player can wager on a particular player hand and a player can wager on more than one player hand.

For the purposes of this invention, the source of the funds and the makeup of the wagers are not significant. The key characteristic of these games is that all players are restricted to one or two types of wagers. In all jurisdictions, the player can wager that a particular player hand will rank higher than the Dealer's hand. In essence, they may bet that they can "beat the dealer".

And in jurisdictions where there is a Player/Dealer, the player may wager on the Dealer hand against all the player hands. If a player wagers on the Dealer hand, his money is used to settle wagers against one player hand after another.

None of these games, as currently played, offer the opportunity to wager that the Dealer hand will beat a particular player hand. You can wager that the player hand will beat the Dealer hand, but not the reverse wager. You can wager that the Dealer hand will generally beat player hands, but not a specific player hand.

In addition, none of the wagering methods used in these games allow you to wager that a particular hand will tie or push with the Dealer hand.

There are many variations of blackjack. Some common variations add jokers to the deck; change the method for deciding who wins, particularly when one or both parties go over 21; change what a "natural" is, and some even change the target number from 21 to 22 or some other value. The field of the invention includes all these variations.

Pai Gow is played with a set of tiles with markings. Each player makes a wager and then receives four tiles. In addition, another four-tile hand is given to the Dealer.

The player divides the four tiles into a pair of two-tile groups. The house or Player/Dealer tiles are also divided into a pair of two-tile groups. Each two-tile player group is compared to one of the two-tile house or Player/Dealer groups according to a ranking scheme for the pairs of tiles. The higher-ranked group is compared to the higher-ranked Dealer group, and the two lower-ranked groups are compared. If both the player's groups beat both the Dealer groups, the player wins an amount equal to his/her wager. If both of the Dealer groups are ranked higher than the player's groups, then the player loses his/her wager to the Dealer. If one is ranked higher and one is ranked lower, then it is a "push" and no money changes hands.

Pai Gow Poker is similar to Pai Gow, but it is played with a deck of conventional playing cards and each player receives seven playing cards. Each party divides his cards into a group of two cards and a group of five cards, and these groups are compared according to the traditional rankings of poker hands. Again, if both groups of either party have a higher ranking than the corresponding groups of the other player, that party wins the wager. Otherwise it is a push.

Pan 9 and variations such as Fast 9 are card games where players are trying to each get as close as possible to a target value of 9. The Dealer and other players are each dealt three cards, and each party has the option to add a fourth card to his/her hand. The values of the cards are added up with face cards counting zero, aces counting one, and all other cards counted at face value. Only the last digit of the hand value is used, so a value of 14 or 24 is counted as a value of four. Pan 9 and it's variations are played with decks of cards with the 7, 8, 9 and 10s removed.

All of these games share the same basic wagering method. You can bet that a particular player hand will beat the Dealer hand. And in some cases you can wager on the Dealer hand against all the player hands. However, you cannot wager that the Dealer hand will beat a particular player hand, and you cannot wager that the Dealer hand will push with or tie a particular player hand.

Traditional Baccarat provides these options. A player can bet on the Dealer hand (typically called the Bank Hand) or a player can wager on the player hand. In addition, the player can wager that the two hands will tie. However, in Baccarat, there is exactly one Dealer hand and exactly one player hand. In traditional Baccarat, there is never more than one player hand. As a result, this traditional form of Baccarat falls outside of the field of this invention.

There are variations of Baccarat where there can be more than one player hand, but the wagering method is the same as the other games in the field of this invention. A wager on a particular player hand is allowed. A wager on the Dealer hand against all player hands is involved. However, you cannot wager that the Dealer hand will beat a particular player hand, and you cannot wager that the Dealer hand will push with or tie a particular player hand. These variations would fall within the field of the invention.

In the field of the invention, when the game is played with a Player/Dealer, there is frequently an additional bet allowed called a "buy bet". This bet occurs when a player wants more action than the other players at the table are willing to provide. This player pays another player to make a wager and the person "buying" the wager takes the other side of the bet. Typically, the Player/Dealer pays another party to wager that a particular hand will beat the Player/Dealer hand. This allows the Player/Dealer to, in essence, make a wager that a particular hand will lose to the Dealer hand. The Player/Dealer must pay another player to make this wager. Players other than the Player/Dealer can also buy a wager on a hand and put up a wager on the Player/Dealer hand.

SUMMARY OF THE INVENTION

The present invention provides an improvement to games that allow more than one player hand with a method of wagering that adds one or two additional types of wager. This wagering method adds a wager that the Dealer hand will beat a particular player hand, called a "Reverse Bet." Optionally the wagering method may also add a wager that a particular player hand will push with the Dealer hand, called the "Push Bet." These wagers may be settled with the same pool of money that is used for bets that a player hand will win, there can be a separate pool of money for these wagers, or there can be individual pools for each wager.

In another embodiment, only the wager that the hands will push with the Dealer is added to the game.

In all embodiments where the push wager is added, the wager may be available at any time or it may only be available if the same player makes another wager.

While the conventional bet typically pays the player the same amount as he is putting at risk (an "even-money" wager), a Reverse Bet may also pay more or less than the player risks. In the preferred embodiment shown below, the player wagers $10 to win $9, $100 to win $90, etc.

If there is Push Bet, this wager may be settled against the same pool of money as other wagers, against a special pool just for these wagers, or against individual pools for each wager. This wager may also not pay even money. It is likely to pay a multiple of the wager made by the player. For example, the player may wager $10 to win $20. The exact payout will depend on the frequency of pushes in the particular game in question.

There are several advantages to the invention. One advantage is that the player has many more wagering opportunities and strategies. For example, a player can "hedge" against the Dealer having a very strong hand by betting his own hand will win, while betting another hand at the table will lose. Or a player may believe he detects a pattern and wish to wager that certain hands will win and others will lose. Additional wagering opportunities mean more excitement for the players and more revenue for the casino.

In addition, the invention can be seen as an improvement over the "buy bet". In a "buy bet" the Player/Dealer can wager that a particular hand will lose to the Dealer hand, but the Player/Dealer must pay another player to make this bet. This payment is not only an extra cost, but may not be allowed in every jurisdiction. With this invention, any player can make the reverse bet at any time and without paying another party to get involved. While in theory, any player could make or pay for a "buy bet", it would not make sense for anyone except for the Player/Dealer to do so, since other players would not be in a position to win the amount bet. In addition, with a "buy bet", there is no opportunity to bet that the two hands will push. Therefore, this invention improves on the "buy bet" in four ways. This invention 1) allows an additional type of wager that a push will occur, for more types of wagers, 2) eliminates the extra cost of the wager, 3) allows this bet in jurisdictions where the "buy bet" is not allowed, and 4) permits a party other than the Player/Dealer to bet that the Player/Dealer hand will beat a specific player hand. In some jurisdictions where the "buy bet" is allowed, only the Player/Dealer can make a "buy bet." In these jurisdictions, the present invention is an improvement, since it allows any player to bet that the Dealer hand will beat a particular hand. Without the Reverse Bet of the present invention, this option would only be available to the Player/Dealer.

U.S. Pat. No. 6,270,078 discloses a version of Pai Gow Poker that "allows a player to bet against the house and/or to bet against the other players." However, this invention discloses a method of wagering either against the house or a Player/Dealer. It does not disclose a method of wagering that the Dealer hand will beat a particular player hand, so it is a different invention from that disclosed in this application.

BRIEF DESCRIPTION OF THE DRAWING FIGURES

DETAILED DESCRIPTION

Those of ordinary skill in the art will realize that the following description of the present invention is illustrative only and not in any way limiting. Other embodiments of the invention will readily suggest themselves to such a skilled person.

For the description of a preferred embodiment, the game of Pai Gow Poker will be used. Those of ordinary skill in the art will realize that this invention can be applied to Pai Gow Tiles, Blackjack, Pan 9, or other wagering games where several players receive hands made up of gaming pieces and try to beat a Dealer hand.

In the game of Pai Gow Poker one participant is designated as Dealer for each hand played. In many jurisdictions, this participant is the casino and players are playing against the House. In other jurisdictions, this is one of the players, designated as the Player/Dealer. In another group of jurisdictions, there may be an agent of the house acting as Player/Dealer on some hands and normal players may act as Player/Dealer on others, as the option to be Player/Dealer rotates around the table. In any of these cases, all other players are trying to beat the Dealer. For the preferred embodiment, we will describe a game where players are playing against a Player/Dealer.

Figure 1:
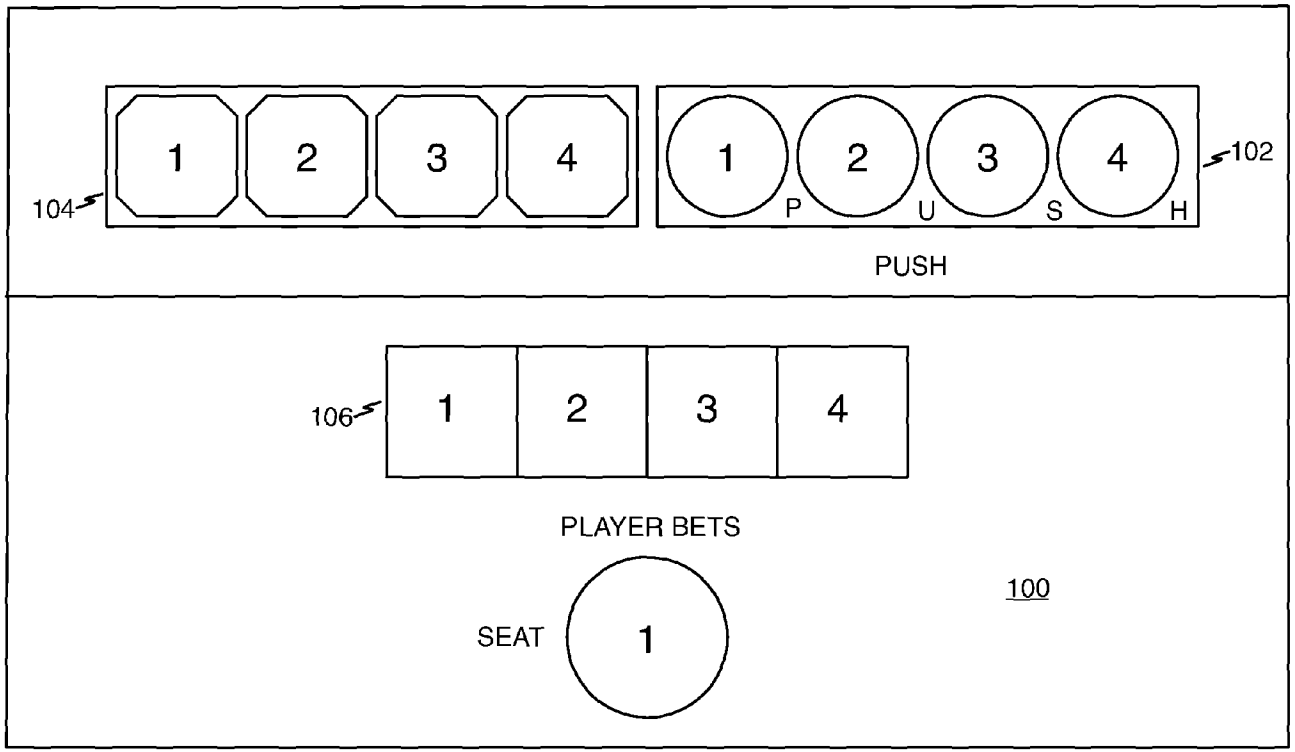
FIG. 1 illustrates an exemplary embodiment of a wagering station for a seated player according to the present invention.

In the preferred embodiment, there is a table with marked stations for each seated player. There are wagering areas at each station. FIG. 1 illustrates an exemplary wagering station 100 for Seat 1. The upper row consists of wagering areas to cover Reverse Bets 102 and Push Bets 104. The figures on the left are to cover up to four Reverse Bets and the circles on the right are to cover up to four Push Bets. The lower row of squares is for traditional wagers 106 that the player hand dealt to this wagering station 100 will beat the Dealer hand, and they are paid from the normal pool of money wagered on the Dealer hand. Up to four separate bets may be made that the hand for Seat 1 will beat the Dealer hand in these lower squares.

A disk or other indicator shows which player is the Player/Dealer for this hand. The option to be Player/Dealer rotates around the table in a systematic fashion, with the next seat to the current Player/Dealer's left being offered the option after the current Player/Dealer has had this role for a fixed number of hands or declines the option.

Figure 2:
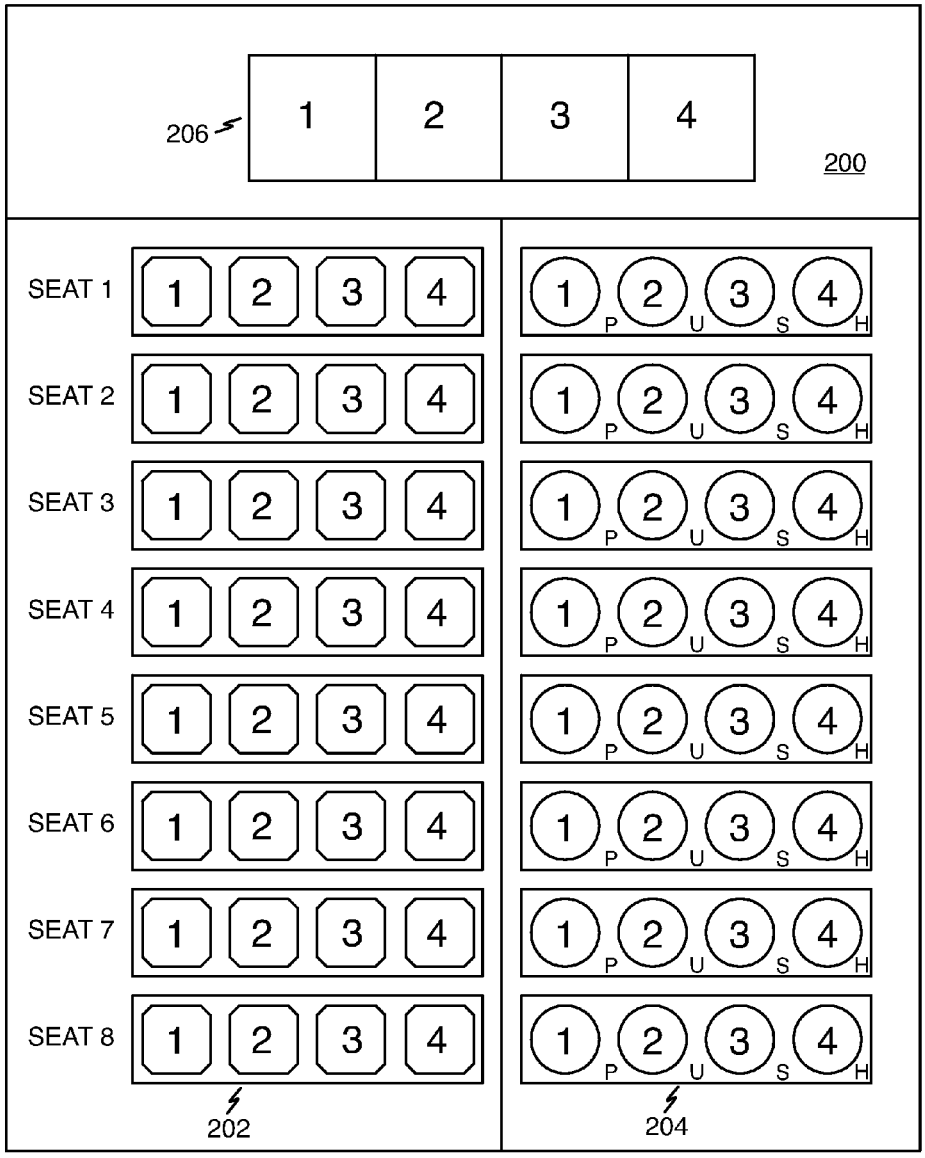
FIG. 2 illustrates an exemplary Player/Dealer wagering station placard according to the present invention.

In the preferred embodiment, a placard covers the Player/Dealer's wagering station providing a different group of wagering areas. This placard could be embossed plastic, laminated plastic, printer cardboard, or any other material. FIG. 2 illustrates an exemplary Player/Dealer wagering station placard 200.

The top row of wagering areas is used to make traditional wagers 206 on the Player/Dealer hand. The Player/Dealer would put his/her wager in the square labeled "1". If this wager were not sufficient to cover all the wagers on player hands, another party might place an additional wager in the square labeled "2". The other squares allow for two more wagers on the Dealer hand. These wagers could be called "non-specific" Player/Dealer wagers since they are wagering that the Dealer hand will beat whatever player hand(s) it is matched up with.

The 8 numbered rows below are wagering areas for Reverse Bets 202 and Push Bets 204. Each row is for a different player hand. The numbers from 1 to 8 running down the left side are not wagering areas. They indicate which seat the Reverse Bets 202 and Push Bets 204 apply to. The figures immediately to the right of these numbers are for Reverse Bets 202. Each figure is a space where a different Reverse Bet 202 can be made. Different players might make these, or a player might choose to make more than one bet it the size of each bet is limited.

Reverse Bets can be made against each player hand. If a player chooses to wager that Dealer hand will beat the hand in Seat 3, the player can place a wager in the figure labeled "1" to the right of the row labeled "Seat 3". This would be matched up with the wager in the similar figure "1" on the wagering station in front of Seat 3. If a player wishes to make an additional wager, they could place it in the figure labeled "2".

The circles to the right of each row provide spaces for up to 4 Push Bets. These wagers would be that the hand indicated by the number on the left will push with the Dealer hand. If a player chooses to wager that the Dealer hand will Push with the hand in Seat 3, the player can place a wager in the circle labeled "1" in the row labeled "Seat 3". This would be matched up with the wager in the circle labeled "1" in front of Seat 3. If a player wishes to make an additional Push Bet, they could place it in the circle labeled "2".

For every Reverse Bet or Push Bet, another party must take the other side of this wager. If a player wishes to do this, he places a wager in front of that seat in the corresponding figure or circle. The wager in circle labeled "3" for seat 8 is matched up with the wager in the circle labeled "3" in front of Seat 8. The wager in the square with the cut-off corners labeled "2" for Seat 5 is matched up with the wager in the square with the cut-off corners labeled "2" in front of Seat 5.

While in the preferred embodiment, the shapes and labels for the wagering areas are used to match up wagers; those of ordinary skill in the art will realize that other mechanisms could be used to match up the wagers. For example, colored chips or other markers might be used to indicate which Reverse Bet or Push Bet matches up with each other wager. Also, those of ordinary skill in the art will realize that the covering wagers might be placed somewhere other than in front of each player seat. There might be wagering areas next to those for the Reverse Bets and Push Bets, for example.

Although, in the preferred embodiment, there are individual wagers to cover each wager that the Dealer hand will beat a player hand, those of ordinary skill in the art will realize that there could be a single wager to cover all these bets or a combination thereof.

These designs for regions of the playing table are illustrative only. Those of ordinary skill in the art will realize that many other table layouts are possible with this wagering method. For example, it is contemplated that the number of seats may vary. It is also contemplated that the number of wagering areas may be greater or less than 4.

In the preferred embodiment, the layout for the wagering station moves from seat to seat as different players choose to act as Player/Dealer. Those of ordinary skill in the art will realize that the layout could also be stationary. There could be a special section of the table for wagers on the Player/Dealer hand, or Player/Dealer wagers could be made on the same layout as wagers on player hands.

Once the wagering is complete, each seat, including the seat of the Player/Dealer is dealt seven cards from a standard deck. Each participant divides his cards into a two-card hand and a five-card hand. The hands are evaluated using the normal method of evaluating poker hands. Straight and flushes do not count in the two-card hand, so highest possible two-card hand is a pair of aces.

In dividing his cards, each participant must set them so that the five-card hand has a higher value than the two-card hand. A two-card hand with a pair of sixes and a five-card hand with a pair of fives would not be legal. However, if the five-card hand contains a pair of sevens, this would be allowed.

After each player divides his cards, the Dealer divides his cards. This may be according to a pre-determined set of rules or the Dealer may have the choice of dividing his hand into any legal set of two hands.

After the Dealer hand is set, all hands are turned over and evaluated. If the Dealer's five-card hand is higher than or equal to a player's five-card hand and the Dealer's two-card hand is higher than or equal to a player's two-card hand, the Dealer hand wins. If a player's five-card hand is higher than the Dealer's five-card hand and the player's two-card hand is higher than the Dealer's two-card hand, the player hand wins. In all other cases, a push occurs.

According to the preferred embodiment, the bets that a player hand will beat the Dealer hand are then settled using the non-specific Player/Dealer wager(s), to the extent there is enough money in non-specific Player/Dealer wager(s) to cover the wagers. Player hands are evaluated in order, going around the table. Usually some event is used to determine which hand is evaluated first, and no one knows which hand this will be until after all the hands are set. All wagers that this hand will win are settled out of the non-specific Player/Dealer wager(s). If the Dealer hand wins, all the wagers to win on this hand are paid to the Player/Dealer. If the Dealer hand loses, the amount of the wager is paid from the non-specific wager on the Dealer hand that covered this wager to the player who wagered on that hand.

Then the specific Player/Dealer wagers are settled. If there are individual amounts to cover these wagers, the wins and loses are settled with the players who make these wagers. If there is a pool of money to cover these wagers, the wagers are settled with the player(s) who provided the pool. In the preferred embodiment, the winners of specific Player/Dealer wagers are paid $9 for every $10 wagered that the Player/Dealer hand would beat that specific player hand. Those of ordinary skill in the art will realize that the amount paid on these wagers could be different. The player could be paid $10 for each $10 wagered, $10 for each $11 wagered, $10 for each $9 wagered, or according to any other formula. If the player's hand wins, these player wagers are paid to the party or parties who have bet against the specific Player/Dealer wagers.

The preferred embodiment describes a game in which the players who make the wagers also make playing decisions for at least one of the hands. Those of ordinary skill in the art will realize that in some embodiments, players might also make wagers on various hands without being involved in the playing decisions. A player might stand behind the seated players who make the decisions and make wagers, without identifying himself with a particular hand as a decision-maker. In addition, there might not be choices for the players to make. There may be specific rules about how each hand must be played.

The preferred embodiment includes a "Push Bet" that is won when a particular player and the Dealer push. In many cases, a push occurs when the player and the Dealer tie. However not every tie is a push in every game. In blackjack, for example, if a Player and the Dealer both have a total of 22, they tie, but they do not push. Also, not every push is a tie. For example in Pai Gow poker, the player may have a better two-card hand and the Dealer may have a better five-card hand. Neither hand ties, but the outcome is a push. Those of ordinary skill in the art will realize that a bet that the hands will tie could be added in addition to the bet that a push will occur or it could be substituted.

Figure 3:
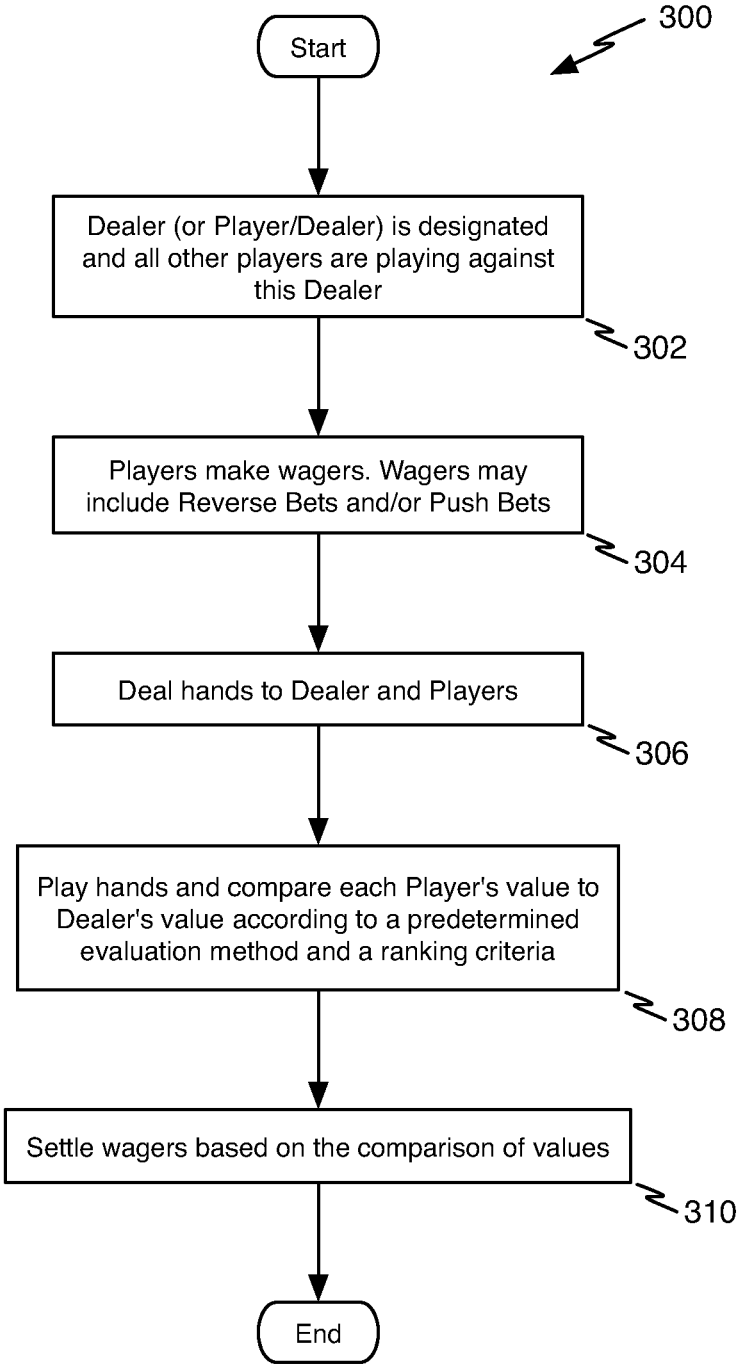
FIG. 3 is a flowchart representing an exemplary embodiment of the general method of the present invention.

FIG. 3 is a flowchart representing an exemplary embodiment of the general method 300 of the present invention. At step 302, a Dealer, or Player/Dealer, is designated and all other players play against this Dealer. More than one player can play against the Dealer and have a different value from other players playing against the Dealer. At step 304, the players make their wagers. Players may make wagers that the Dealer's value will be better than the value of a particular player, a Reverse Bet. Players may additionally, or in the alternative, make wagers that the Dealer's value will be equal to the value of a particular player, a Push Bet. At step 306, hands are dealt to the Dealer and the players. At step 308, the hands are played and each player's value is compared to the Dealer's value according to a pre-determined evaluation method for determining the value and a ranking criterion for deciding which value is higher. At step 310, the wagers are settled based on the comparison of the values.

Although the invention has been illustrated and described in detail herein, it is to be understood that various changes and modifications may be made therein without departing from the spirit and scope of the invention as defined in the appended claims.

What is claimed is:

1. A method of wagering in a game played by a Dealer and at least one Player comprising:

providing a set of gaming tokens;

affording each Player an opportunity to make a primary wager that a hand of tokens dealt to that Player will beat a hand of tokens dealt to the Dealer in accordance with first predetermined payoff criteria including conditions for one hand beating another hand and how much winning wagers are paid;

affording the Dealer and each Player an opportunity to a separate secondary wager that the hand of tokens dealt to the Dealer will beat the hand of tokens dealt to a particular Player in accordance with second predetermined payoff criteria including conditions for one hand beating another hand and how much winning wagers are paid, at least one of the second criteria being different from the first criteria;

dealing tokens to the Dealer and to each Player;

determining for each primary wager whether it was won using the first pre-determined criteria;

paying each Player who won the primary wager and collecting the wager of each player who lost the primary wager;

determining for each secondary wager that it is won when the Dealer's hand beats hand of the particular Player that was the subject of that secondary wager, according to the second pre-determined criteria, and;

paying each Player who won the secondary wager and collecting the wager of each player who lost the secondary wager.

2. A method of wagering in a game played by a Dealer and at least one Player comprising:

providing a set of gaming tokens;

affording each Player an opportunity to make a primary wager that a hand of tokens dealt to that Player will beat a hand of tokens dealt to the Dealer in accordance with first predetermined payoff criteria including conditions for one hand beating another hand and how much winning wagers are paid;

affording the Dealer and each Player an opportunity to offer to make a separate secondary wager that the hand of tokens dealt to the Dealer will beat the hand of tokens dealt to a particular Player in accordance with second predetermined payoff criteria including conditions for one hand beating another hand and how much winning wagers are paid;

affording ones of the Dealer and each Player who have been offered a secondary wager an opportunity to accept the offer of a secondary wager;

dealing tokens to the Dealer and to each Player;

determining for each primary wager whether it was won using the first pre-determined criteria;

paying each Player who won the primary wager and collecting the wager of each player who lost the primary wager;

determining for each secondary wager that it is won when the Dealer's hand beats hand of the particular Player that was the subject of that secondary wager, according to the second pre-determined criteria, and;

paying each Player who won the secondary wager and collecting the wager of each player who lost the secondary wager.

3. The method of claim 2 wherein at least one of the first payoff criteria are different from the second payoff criteria.

4. The method of claim 2, further including:

arranging the tokens into a first group and a second group by the Dealer and each Player, where the first group must be higher ranked than the second group using the rankings of one of Pai Gow Poker and Pai Gow tiles;

determining for each primary wager whether it was won using the pre-determined criterion for primary wagers;

paying each Player who won the primary wager and collecting the wager of each player who lost the primary wager; and wherein determining for each secondary wager that it is won when the Dealer's hand beats hand of the particular Player that was the subject of that secondary wager, according to the second pre-determined criteria comprises:

for each Player who has made a secondary wager, determining from the ranking whether the Dealer's first group beats the first group of the particular Player that was the subject of that secondary wager and whether the Dealer's second group beats the second group of the particular Player that was the subject of that secondary wager; and determining for each secondary wager that it is won when both the Dealer's first group and second group beat the first group and the second group of the particular Player that was the subject of that secondary wager, that it is a push when only one of the Dealer's first group and second group beat the first group and the second group of the particular Player that was the subject of the secondary wager, and that it is otherwise lost.

5. The method of claim 4 wherein at least one of the first payoff criteria are different from the second payoff criteria.

6. A method of wagering in a game of Pai Gow Poker played by a Dealer and at least one Player comprising:

providing a set of Pai Gow Poker tokens;

affording each Player an opportunity to make a primary wager that a hand of tokens dealt to that Player will beat a hand of tokens dealt to the Dealer in accordance with first predetermined payoff criteria including conditions for one hand beating another hand and how much winning wagers are paid;

affording the Dealer and each Player an opportunity to offer to make a separate secondary wager that the hand of tokens dealt to the Dealer will beat the hand of tokens dealt to a particular Player in accordance with second predetermined payoff criteria including conditions for one hand beating another hand and how much winning wagers are paid;

affording ones of the Dealer and each Player who have been offered a secondary wager an opportunity to accept the offer of a secondary wager;

dealing tokens to the Dealer and to each Player;

arranging the tokens into a first group and a second group by the Dealer and each Player, where the first group must be higher ranked than the second group using the rankings of Pai Gow Poker;

determining for each primary wager whether it was won using the first predetermined payoff criteria;

paying each Player who won the primary wager using the first predetermined payoff criteria and collecting the wager of each player who lost the primary wager;

for each Player who has made a secondary wager, determining from the ranking whether the Dealer's first group beats the first group of the particular Player that was the subject of that secondary wager and whether the Dealer's second group beats the second group of the particular Player that was the subject of that secondary wager;

determining for each secondary wager whether it is won according to the second pre-determined payoff criterion for secondary wagers; and paying each Player who won the secondary wager according to the second predetermined payoff criteria and collecting the wager of each player who lost the secondary wager.

7. The method of claim 6 wherein at least one of the first payoff criteria are different from the second payoff criteria.

8. The method of claim 7 wherein:

the payoff criteria for the primary bet includes that the payoff to the player is 1 to 1; and the payoff criteria for the secondary wager includes that the payoff to the player is more than the player's wager.

9. The method of claim 8 wherein the payoff criteria for the secondary wager includes that the payoff to the player is $10 for every $9 wagered by the player.

10. A method of wagering in a game of Pai Gow tiles played by a Dealer and at least one Player comprising:

providing a set of Pai Gow tiles;

affording each Player an opportunity to make a primary wager that a hand of tiles dealt to that Player will beat a hand of tiles dealt to the Dealer in accordance with first predetermined payoff criteria including conditions for one hand beating another hand and how much winning wagers are paid;

affording the Dealer and each Player an opportunity to offer to make a separate secondary wager that the hand of tiles dealt to the Dealer will beat the hand of tiles dealt to a particular Player in accordance with second predetermined payoff criteria including conditions for one hand beating another hand and how much winning wagers are paid;

affording ones of the Dealer and each Player who have been offered a secondary wager an opportunity to accept the offer of a secondary wager;

dealing tiles to the Dealer and to each Player;

arranging the tiles into a first group and a second group by the Dealer and each Player, where the first group must be higher ranked than the second group using the rankings of Pai Gow tiles;

determining for each primary wager whether it was won using the rules of Pai Gow tiles;

paying each Player who won the primary wager and collecting the wager of each player who lost the primary wager;

for each Player who has made a secondary wager, determining from the ranking whether the Dealer's first group beats the first group of the particular Player that was the subject of that secondary wager and whether the Dealer's second group beats the second group of the particular Player that was the subject of that secondary wager;

determining for each secondary wager that it is won when both the Dealer's first group and second group beat the first group and the second group of the particular Player that was the subject of that secondary wager, that it is a push when only one of the Dealer's first group and second group beat the first group and the second group of the particular Player that was the subject of the secondary wager, and that it is otherwise lost; and paying each Player who won the secondary wager and collecting the wager of each player who lost the secondary wager.

11. The method of claim 10 wherein at least one of the first payoff criteria are different from the second payoff criteria.

12. The method of claim 11 wherein:

the payoff criteria for the primary bet includes that the payoff to the player is 1 to 1; and the payoff criteria for the secondary wager includes that the payoff to the player is more than the player's wager.

13. The method of claim 12 wherein the payoff criteria for the secondary wager includes that the payoff to the player is $10 for every $9 wagered by the player.

* * * * *